US007383951B2

(12) United States Patent
Smolenski et al.

(10) Patent No.: US 7,383,951 B2
(45) Date of Patent: Jun. 10, 2008

(54) FREIGHT PALLET WITH DETACHABLE BASE SHED

(75) Inventors: Michael J. Smolenski, West Chester, PA (US); Rudy Posthumus, Harmonielaan (BE); Hubertus A. M. Frijns, Leijstenstraat (NL)

(73) Assignee: Coli-Tainer, Ltd., West Chester, PA (US)

( * ) Notice: Subject to any disclaimer, the term of this patent is extended or adjusted under 35 U.S.C. 154(b) by 90 days.

(21) Appl. No.: 11/180,154

(22) Filed: Jul. 13, 2005

(65) Prior Publication Data

US 2007/0012588 A1 Jan. 18, 2007

(51) Int. Cl.
*B65D 19/00* (2006.01)

(52) U.S. Cl. ..... 206/386; 206/597

(58) Field of Classification Search ..... 108/54.1, 108/55.3, 901, 902, 51.11, 55.1, 56.3, 57.13; 206/386, 597; 410/47, 49, 50; 414/495; 280/15–18, 20, 21.1, 28.17, 28.12, 24
See application file for complete search history.

(56) References Cited

U.S. PATENT DOCUMENTS 2,942,827 A * 6/1960 Edson ..... 108/54.1
5,117,762 A * 6/1992 Shuert ..... 108/57.25
5,255,613 A * 10/1993 Shuert ..... 108/52.1
5,306,026 A * 4/1994 Jesse ..... 280/18
5,413,054 A 5/1995 Collins
6,231,284 B1 5/2001 Kordel

* cited by examiner

*Primary Examiner*—Mickey Yu
*Assistant Examiner*—Steven A. Reynolds
(74) *Attorney, Agent, or Firm*—Duane Morris LLP

(57) ABSTRACT

A pallet can be detachably carried on a sled for shipping heavier objects on the pallet as carried by the sled, or lighter object on the pallet alone, the sled spreading the weight over a greater area than the pallet alone. The dimensions of both the pallet and sled are related to contribute different integer fractions of a given dimension such as the length of a standard intermodal container. This arrangement is apt for shipping smaller steel coils on pallets and larger steel coils on pallets carried by sleds. Thus, for example, quarter-container-length pallets, normally appropriate for a pallet to carry lighter coils, can carry heavier loads on a sled occupying a larger proportion of the container length, such as a half-container-length sled. An attachment mechanism affixes the sled to the pallet and the assembly is configured for manipulation with a fork lift.

14 Claims, 8 Drawing Sheets

FREIGHT PALLET WITH DETACHABLE BASE SHED

FIELD OF THE INVENTION

The invention relates to the transportation of objects by container, especially heavy sheet metal coils transported by intermodal container, but also other types of loads. A modular pallet system is provided for accommodating greater or lesser loads in a given container area.

A small number of large and/or heavy loads can be arranged using the pallet and sled system to occupy correspondingly large container spaces; and/or a larger number of smaller and/or lighter loads can occupy smaller container spaces; so that the loads fill the available container space and the overall container load is appropriately distributed. According to one aspect, larger and smaller loads are carried using substantially the same type of load cradling pallet part. When the pallet part carries a large/heavy load, the pallet part is fit into an adapter base sled that is correspondingly large and distributes the load over a larger area in the container. The pallet parts and one or more sizes of base sleds are integer multiples of a fraction of the container size. The pallet part and the base sled are structured so that one or the other or both can be handled with a fork lift, as discrete loads.

BACKGROUND

Pallets are conventionally used to ship various types of goods. Placing a load of goods on a pallet, particularly if tied down and attached securely to the pallet, allows the load to be handled efficiently using vehicles or devices having manipulators adapted to fit into or under the pallet, such as the tines of a fork lift. This affords protection for the goods. Handling stresses are borne by the pallet. There is substantial efficiency in handling the goods as a unit load larger than cartons or other components in the load. The pallet is a standardized platform on which odd shaped goods may be carried. Pallets can be associated with structural spacers for stacking.

Some of the same advantages enjoyed when using pallets have led to the development and widespread adoption of intermodal containers. Intermodal containers can accommodate multiple pallet loads, providing the ability to handle an even larger load as a unit. Intermodal containers also provide standardization of sizes. More capable manipulators can be used in addition to fork trucks. The containers are typically closed boxes that can be stacked. The containers can be connected to one another, for example by corner couplings for stacking in registry, and also for fitting standardized berths on ships, truck and rail chassis and the like.

Containers offer superior protection for their contents. The container and its load are readily transferred between different modes of transport, e.g., road, rail or ship, carrying along the protection and convenience, without the need to open the container unless the load is to be broken. Large ocean-going vessels have been designed for handling the containers which can be stacked one on top of the other perhaps as many as seven high, with the container framing carrying the weight of the contents of the stack. The standard width of ISO containers is 8 feet (2.44 m), the standard heights are 8 feet 6 inches (2.59 m), and 9 feet 6 inches (2.9 m), and the most common lengths are 20 feet (6.1 m) and 40 feet (12.19 m). The containers are also manufactured in a number of different lengths from 24 feet (7.31 m) to 56 feet (17.22 m). The 20 foot length is a common variety, internally about 6 m long by 2.4 m wide.

Containers are often regarded as appropriate for loads comprising smaller packages such as cartons. Some products involve relatively large and/or heavy units and are sometimes transported as bulk loads, rather than in containers. However, transport of such loads in containers, if possible, can have distinct advantages.

One type of product that is still frequently transported as a bulk load on board ship is steel coil. These coils comprise elongated sheet metal strips in various widths weighing up to 25,000 kg. The coils are stored in dockside warehouses on the order of 20,000,000 to 50,000,000 kg storage capacity. Sufficient warehouse capacity is needed to accumulate and dispense stock so as to smooth over time variations between the demand for steel coils and periodic shipments. If regular supplies could be established, less warehouse capacity might be sufficient.

Transportation of bulk cargo such as steel coils, may expose the cargo to potential damage. Mechanical damage can result if a coil is struck or dropped. Environmental damage can occur, for example from exposure to the elements, such as sea water. Resting a coil on a flat surface or stacking a coil in a nested stack can cause deformation. Resting the coils on the ground or on a wet or dusty surface can introduce unwanted dirt, and can damage the coils when stones or uneven surfaces are beneath the coil. Often the sheet coil material has been provided with a surface treatment at some expense, such as a surface coating of organic paint or another finish. Such a coating or finish advantageously should be protected against damage. For bulk coil cargo, problems of exposure and the like have led to encapsulation of the coils in protective packaging. Many of these problems might be avoided if the coils could be transported in containers. But there are problems. One problem results from the fact that the coils can be very heavy and their weight is densely concentrated.

Standard intermodal containers may be structured to carry substantial weight, but typically the weight is distributed evenly over the available floor area of the container in laterally abutting units such as palleted cartons. Assuming that a dense and heavy weight such as a sheet metal coil is mounted on a pallet, all the weight of the coil is applied to the area encompassed by the pallet. This weight may be too concentrated. Assuming a container is designed, for example, to carry up to 30,000 kg, that weight is expected to be distributed over the floor and not applied to only a small area of the container floor. A typical steel coil, weighing 7,000 kg or more, carried on a typical pallet, may exceed a container's design capacity as to weight concentration. If a coil is a lone weight on a pallet and/or if the pallet is a small item in a container, of whatever weight, dynamic loads imposed during transportation at sea may cause the weight to move, and develop inertial force that is more than the container structure can bear.

The coils can be carried on pallets that are sized to occupy an area of the container, wherein the area occupied is proportional to the weight of the coils to be carried, and perhaps also encompasses the corresponding proportionate area of the container. In that case (and assuming that the pallets are weighty as well), the standard 30,000 kg capacity shipping container might carry three 7,000 kg coils, each on a structure occupying a third of the floor space, or two 13,000 kg coils, each occupying half, or one 25,000 kg coil on a structural reinforcing pallet that distributes the weight over the whole area.

Such a technique is exemplified by U.S. Pat. No. 6,231,284—Kordel. According to that patent and the products available currently from Coil-Tainer Ltd., West Chester, Pa., large pallets that occupy the full width of standard shipping containers are designed to handle very heavy cylindrical loads such as steel coil. The pallets are considered "modular" in that pallets are proportionately sized to distribute the weight of coils over integral lengths of the container. For example, a container can be filled with two half-length pallets, four quarter-length pallets or two quarter-length and one half length pallet. Empty pallets can be used to take up space and lock in load-bearing pallets in a partially-full container.

The pallets disclosed in Kordel thus help to solve problems associated with weight distribution and permit the use of intermodal type containers to carry dense heavy weights such as sheet metal coils. However, this system relies on having a range of pallet sizes (or at least two distinct pallet sizes), and that has introduced logistical difficulties and inefficiencies. Often, larger and heavier steel coil is routinely shipped to a given destination for processing in the production of products. Smaller and lighter processed steel coil is more likely to be shipped out from that location than large coils. As a result, large pallets accumulate at that destination and there is an insufficient supply of smaller pallets.

In the foregoing scenario, it is possible to use the extra large pallets (e.g., half-container-length) pallets to ship out smaller coils (e.g., coils that could be carried in a quarter of the container capacity instead of half). It is also possible to ship a supply of small pallets to the destination, empty, and to ship the large pallets back to the original shipping point, also empty. Either the pallets are under-utilized or the containers are under-utilized, or both.

Known modular pallet arrangements could be effective for distributing the weight of large or small coils or other loads proportionately over the area available in a container. The known technique also could efficiently use available shipping capacity. Due to the lopsided movement and need for large and small pallets, it has not been possible to realize both objectives. There is a need for a palletization system that can better realize the potential to accommodate both large and small steel coils, to use all the shipping capacity that is available in containers as well as the pallets they carry, and at the same time to reduce the need to support the operation by shipping pallets and equipment unloaded or otherwise used to less than their full capacity.

SUMMARY OF THE INVENTION

In order to solve the problem of having to ship empty large pallets back to the source of large steel coils, an adapter sled for quarter-length pallets is proposed. According to one embodiment, the sled has the same footprint as a half-length pallet in order to distribute the weight of heavier payloads across the same surface area of a standard shipping container as a half-length pallet. The sled also features raised guides to lock into position a quarter-length pallet and a locking mechanism to attach the quarter-length pallet to the adapter sled for lifting of the assembly by a fork lift truck.

In addition to distributing the weight of a large load on a larger footprint, the sled maintains the desirable aspect of a prior art half-length pallet in that the fact that it is an integer fraction of the length of a standard container and thus requires no additional bracing to prevent front-to-back movement when used in combination with either another such sled or two quarter-length pallets or a half-length pallet.

Another aspect of the invention is that the sled is flat and easily stackable. Thus many sleds can be densely packed and shipped back to the source of large steel coils without wasting large amounts of container space. The sled preferably also weighs less than the difference between a larger type and smaller type coil cradle pallet, thus reducing cargo weight on the return trip to the source of large steel coils.

BRIEF DESCRIPTION OF THE DRAWINGS

The invention is best understood from the following detailed description when read with the accompanying drawing figures.

DETAILED DESCRIPTION

In the following detailed description, for purposes of explanation and not limitation, exemplary embodiments disclosing specific details are set forth in order to provide a thorough understanding of the present invention. However, it will be apparent to one having ordinary skill in the art having had the benefit of the present disclosure, that the present invention may be practiced in other embodiments that depart from the specific details disclosed herein. Moreover, descriptions of well-known devices, methods and materials may be omitted so as to not obscure the description of the present invention.

Figure 1:
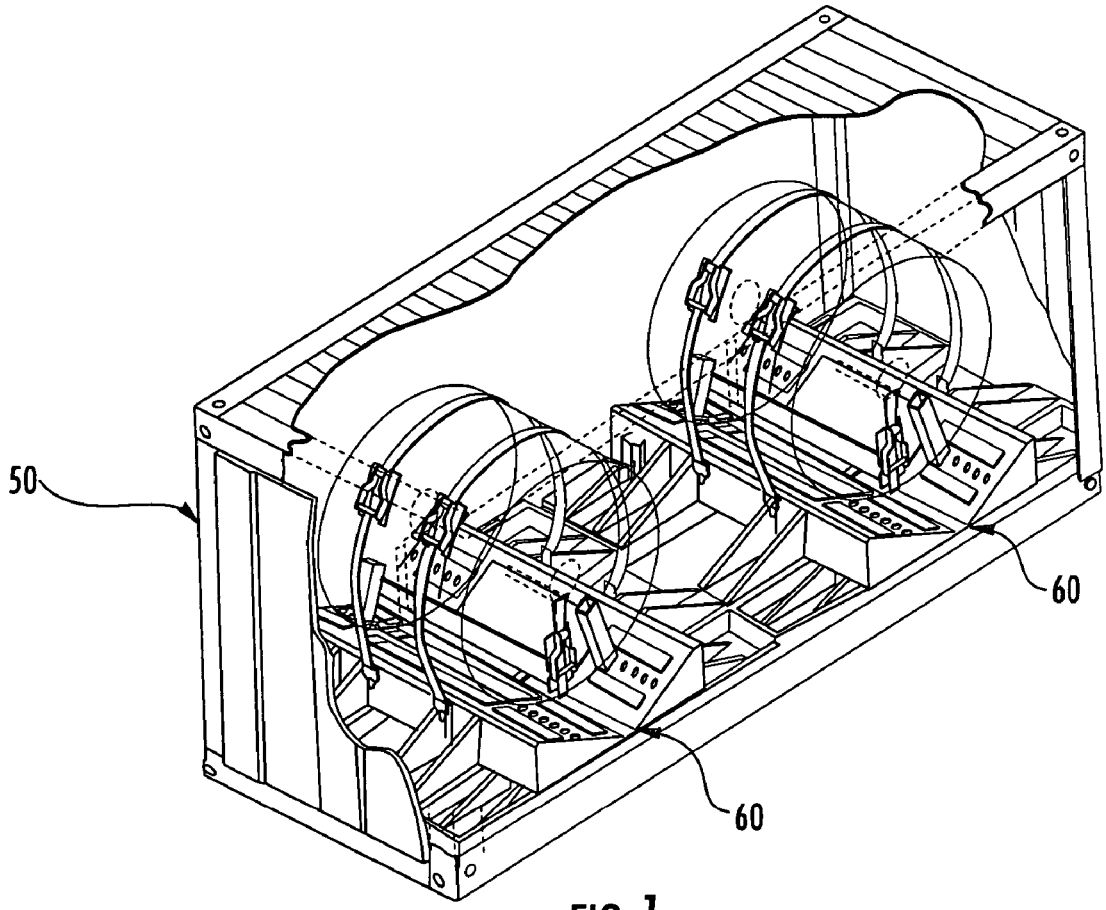
FIG. 1 illustrates a shipping container loaded with two half-length pallets.
Figure 2:
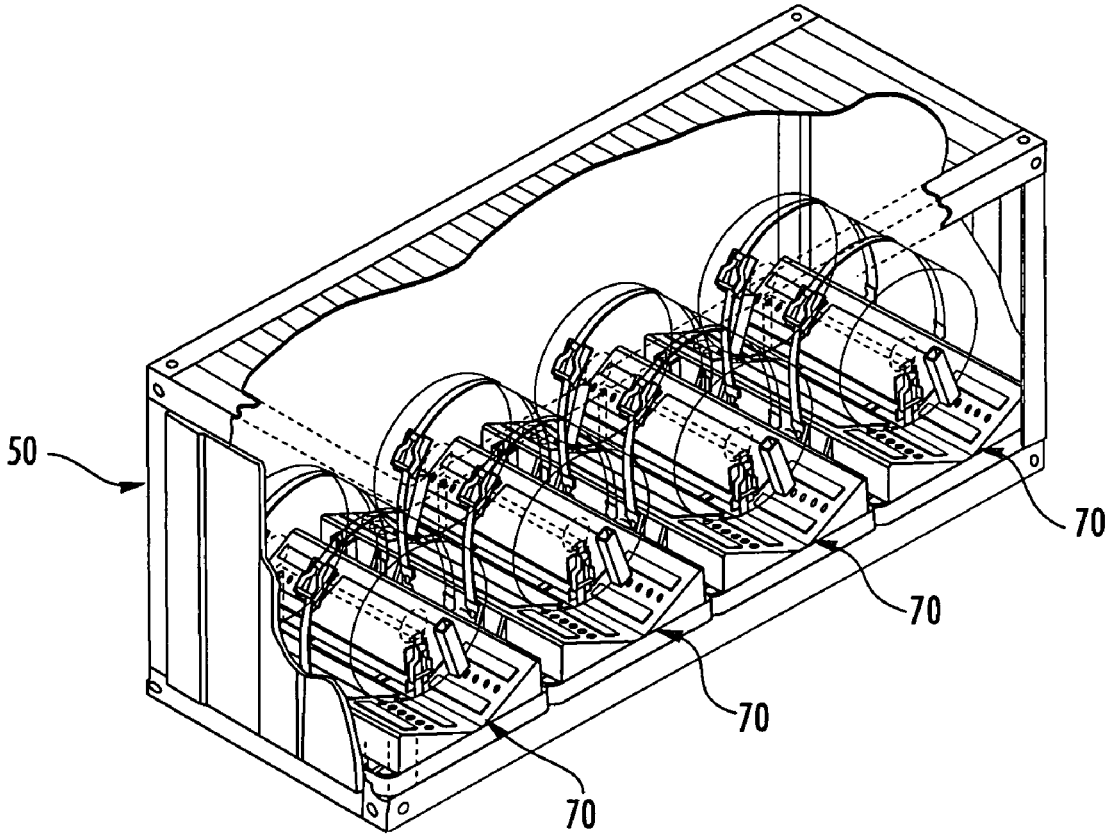
FIG. 2 illustrates a shipping container loaded with four quarter-length pallets.

FIG. 1 shows a standard shipping container 50 (6 m long by 2.438 m wide), loaded with two half-length coil-bearing pallets 60. FIG. 2 shows the same container loaded with four quarter length coil-bearing pallets 70. From these figures, it can be readily seen how these pallets accommodate the full interior floor space of a standard shipping container to the cylindrically-shaped coiled steel loads.

Figure 3:
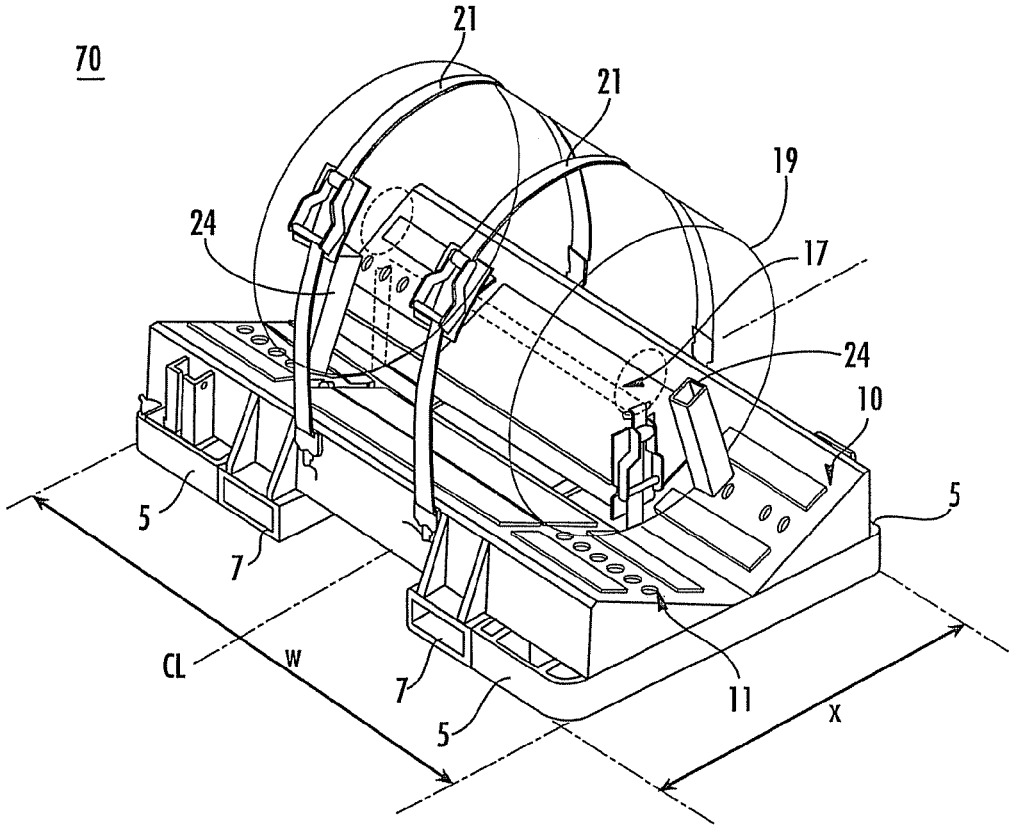
FIG. 3 Prior Art
FIG. 3 illustrates a prior art quarter-length pallet.

FIG. 3 shows a quarter-length pallet 70, with load 19, according to the prior art, U.S. Pat. No. 6,231,284 (Kordel). Among the notable features of the quarter-length pallet are its width, w, which complements the interior width of a standard shipping container, e.g., occupying the full width, less a small amount of clearance for easily inserting and removing the pallet from a container. In this embodiment, length, x is one quarter of the length of the interior length of a standard shipping container. The pallet also features slotted members 7 in the base, for accepting the tines of a fork lift. The pallet features inclined surfaces 10 and 11 adapted to cradle cylindrically shaped loads such as sheet steel in coiled form. The pallet also has most of its base area (5 and 7) located toward the outer edges of width w, so as to distribute weight to the strongest portion of a shipping container and away from the weaker center portion of the container floor. Finally, the pallet features various load restraining devices, including lateral movement limiting posts 24 and tie-down straps 17 and 21.

Figure 4:
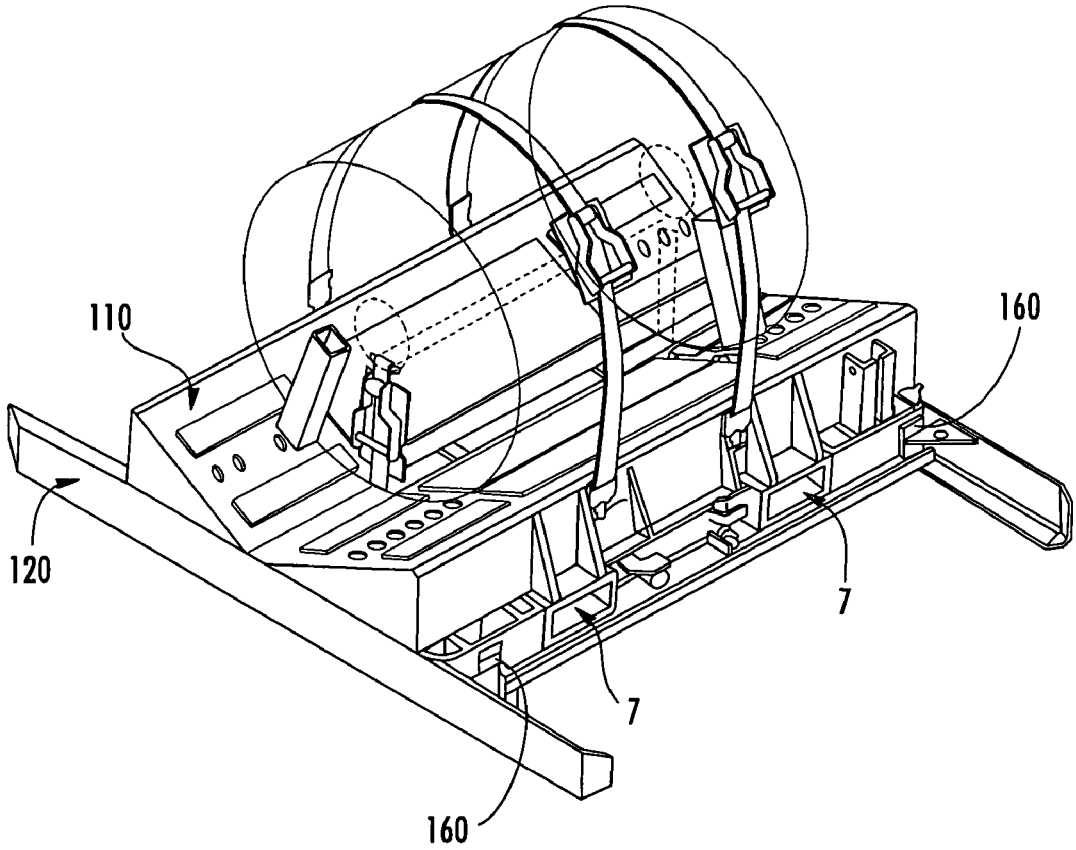
FIG. 4 illustrates an adapter sled loaded with a prior art quarter-length pallet.

FIG. 4 shows an embodiment of the invention, with a prior art quarter length pallet 110 installed on an adapter sled 120. Notable features of the adapter sled are that its width, w, is the same width as the pallet (2.33 m) and that it's length in this example (2.93 m) is one half the length of the interior of a standard shipping container.

Also apparent in FIG. 4 is that the fork lift slots 7 on the quarter length pallet are accessible while the pallet is installed on top of the adapter sled. FIG. 4 also shows the design feature of adapter sled guides 160 that aid in positioning the quarter length pallet 110 on top of the adapter and also prevent front-to-back movement of the pallet on the sled. As shown in FIG. 4, the whole assembly—sled, pallet and coil—can be lifted up by a fork lift and maneuvered into a shipping container as a unit.

Figure 5:
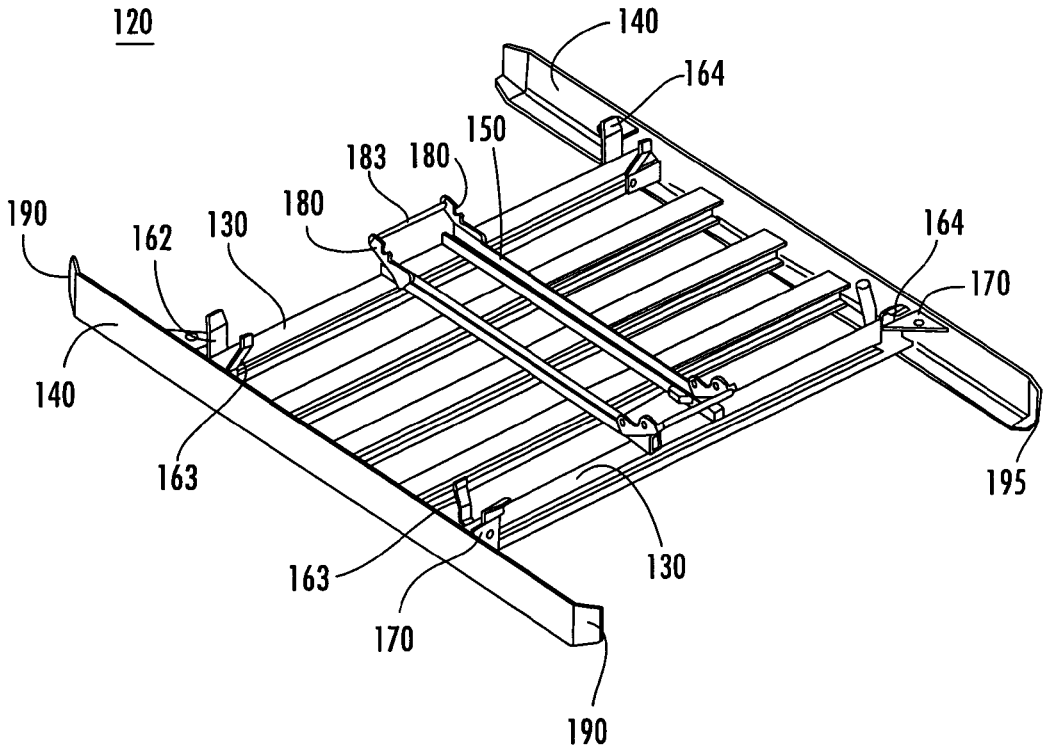
FIG. 5 illustrates an adapter sled, which is an embodiment of the invention.

FIG. 5 is an isometric depiction of an exemplary version of the invention. The sled 120 is based on a rigid "H" shaped structure comprised of two longitudinal members 140, having an essentially "L" shaped cross section. The longitudinal members are attached by a plurality of cross members 130, having an I-beam cross section. Cross members 130 rest on and are affixed to the upper horizontal surface of the longitudinal members. Because cross members 130 are affixed to the top of the horizontal portion of the longitudinal members, cross members 130 do not contact the floor of a cargo container. Thus, all of the weight of the coil, pallet and sled is shifted to the outside edges of the container, which is typically its strongest part. Longitudinal members 140 have an inward-bend 190 in the vertical portion of the member, to aid in guiding the pallet into a shipping container and to prevent the pallet from hanging up on the corrugations in the walls of most shipping containers. Similarly, an end portion 195 of the horizontal portion of the longitudinal members is bent slightly upward to aid in positioning the pallet and prevent the pallet from possibly gouging the bottom of a shipping container when loaded by a forklift.

At each of the ends of the two outer-most cross members 130 are guide plates 162 and 163. The outer guide plates, 162 are spaced slightly farther apart than the length of a quarter-length pallet and limit the quarter-length pallet's forward and read-ward position on the adapter sled. The inner guide plates are adapted and positioned to engage an open area on the quarter-length pallet, and further limit the travel of the quarter length pallet. Lateral travel of the quarter-length pallet is limited both by guide plates 163 and by the side walls of longitudinal members 140, which extend above the horizontal surface of lateral members 130. Side walls of longitudinal members 140 also prevent the pallet from damaging the inside wall of the cargo container.

Outer guide plates 163 are reinforced by triangular plates 170. This reinforcement resists bending of plates 163 when a quarter-length pallet is positioned onto the adapter sled by a fork lift. The outward facing surface 164 of guide plates 162 is designed to guide the quarter-length pallet into position in the event that the quarter-length pallet is not accurately positioned by the fork lift operator. Finally, guide plated 163 also prevent movement of the pallet during transit.

A mechanism for attaching the adapter sled to the quarter-length pallet includes longitudinal members 150, which are attached to the upper surfaces of lateral members 130 and spaced equidistant from the center of the lateral members. In the embodiment depicted, longitudinal members 150 are "U" shaped in cross section.

Figure 6:
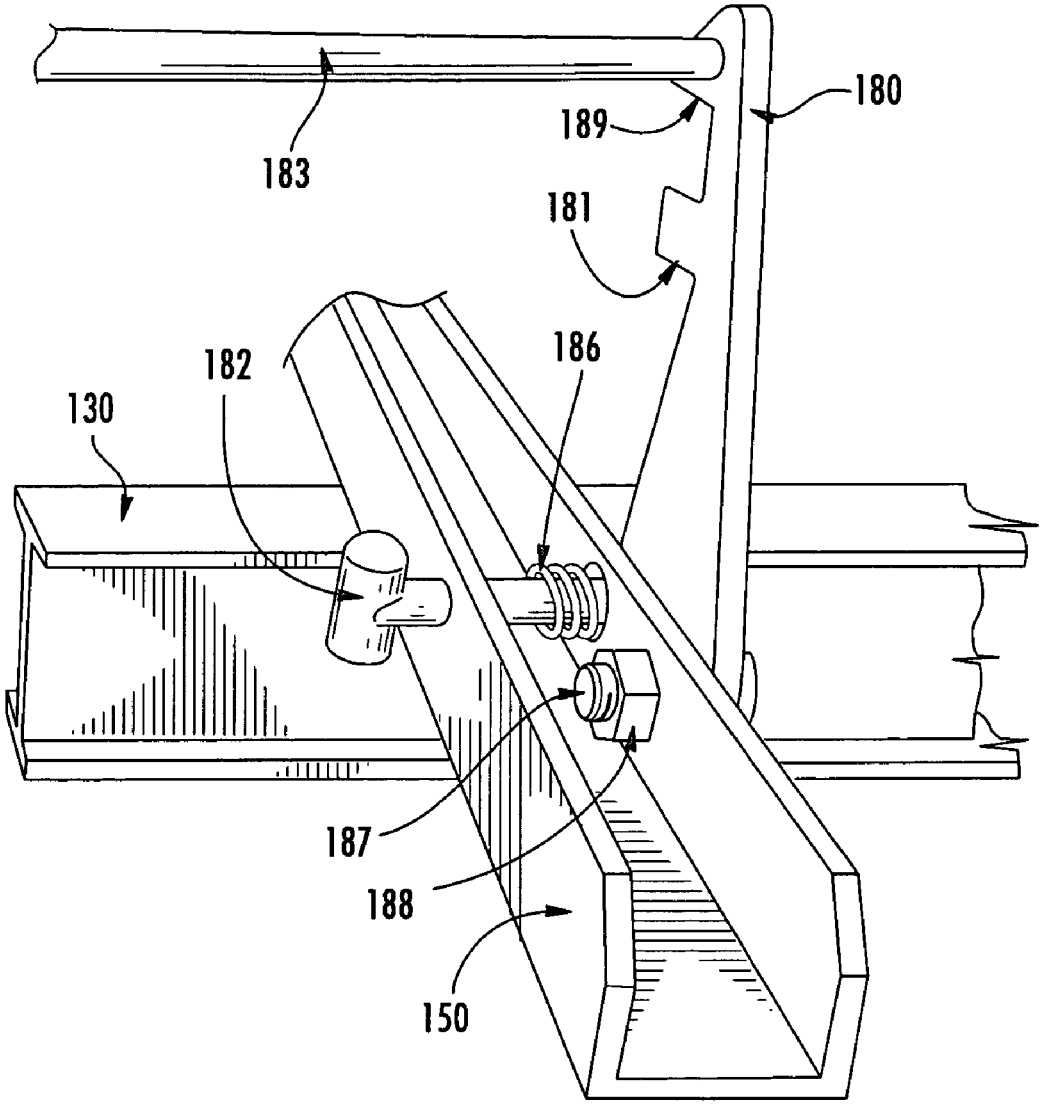
FIG. 6 illustrates a detailed view of an embodiment of the invention showing a latching mechanism for attachment to a quarter-length pallet, wherein the latching mechanism is in a latched position.
Figure 7:
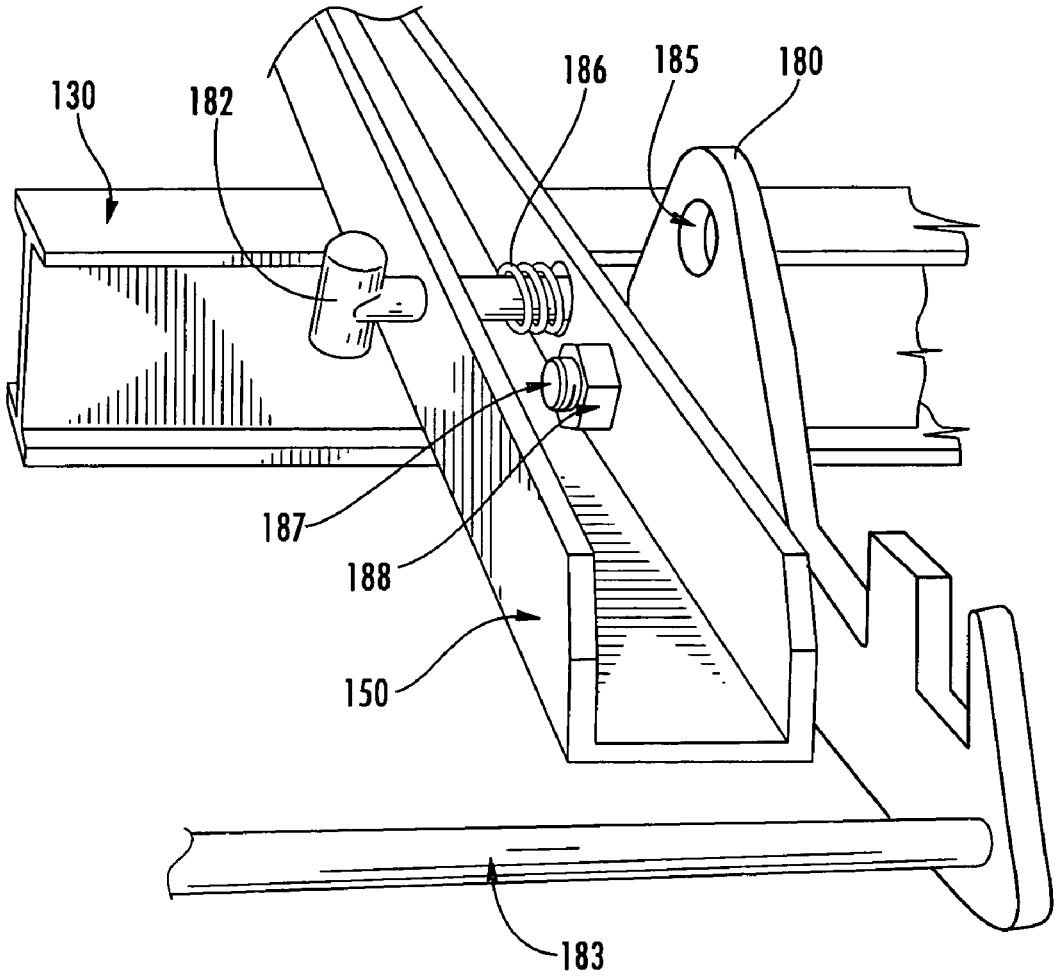
FIG. 7 illustrates a detailed view of an embodiment of the invention showing a latching mechanism for attachment to a quarter-length pallet, wherein the latching mechanism is in an open position.

As shown in FIG. 6, which is a detailed view of an embodiment of a mechanism for attaching the adapter sled to a prior art quarter-length pallet, clamping plates 180 are pivotally attached by bolt 187 and nut 188 at the ends of longitudinal members 150. The pivot point on the clamping plates is designed to allow the plates to open outwards by the force of gravity, such that the plates must be manually or otherwise urged into a closed position engaging under-members of the quarter-length pallet. In an embodiment depicted in FIG. 7, the clamping plates are capable of being locked into a closed position by a spring-loaded pin 182 which inserts into a hole 185 in the clamping plate 180 when the clamping plate is in the closed position. As shown in FIG. 5, a pair of clamping plates 180 are attached at each end of the adapter sled. Each plate in a pair is connected to the other plate by connecting member 183, which can also be seen in detail in FIGS. 6 and 7.

Figure 8:
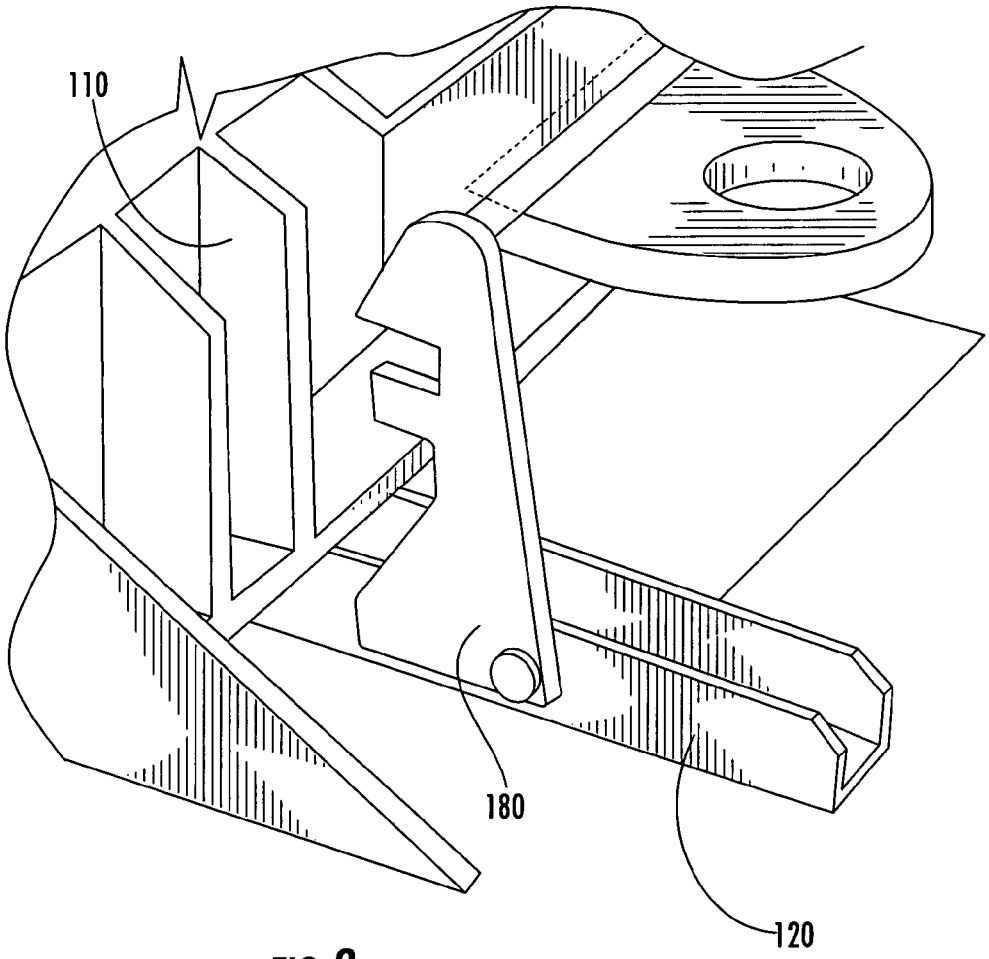
FIG. 8 illustrates a detailed view of an adapter sled latched to a prior art quarter-length pallet.

FIG. 6 shows the clamping plate in an upright, closed position with latching pin 182 inserted into a hole (not visible in this view) in clamping plate 180. As seen in this view, latching pin 182 is spring loaded by spring 186, such that the latching pin is forced into the hole in clamping plate 180 by the spring. This requires that latching pin 182 be pulled by the "T" shaped handle to release the latching plate to pull it away from its closed position. Likewise, the latching pin must be pulled to position the clamping plate into its closed position when latching a quarter-length pallet onto the adapter sled. Also visible in FIG. 6 is an aspect of clamping plate 180, which is adapted to latch onto quarter-length pallets of differing configurations. Clamping plate 180 has two horizontal surface areas, 181 and 189, either of which can engage a upper horizontal surface on a quarter-length pallet. FIG. 8 shows a detailed view of a clamping plate 180 of an adapter sled 120 latched to a quarter-length pallet 110.

As shown in FIG. 5, the longitudinal members 150 are positioned so that the underside of a quarter-length pallet does not contact them, but rather rests solely on the upper horizontal surfaces of lateral members 130.

In this embodiment, a pallet can be picked up by a fork lift and lowered onto the sled. As depicted in FIG. 4, the adapter sled 120 is attached to the quarter-length pallet 110, such that a fork lift can raise the two-pallet assembly by engaging the open channels 7 of the quarter-length pallet and lifting the quarter-length pallet, with the adapter sled slung beneath the quarter-length pallet and the adapter sled bearing no weight while the fork lift is operating.

The foregoing discussion of the invention has been presented for purposes of illustration and description. Further, the description is not intended to limit the invention to the form disclosed herein. Consequently, variations and modifications commensurate with the above teachings and with the skill and knowledge of the relevant art are within the scope of the present invention. The embodiment described herein above is further intended to explain the best mode presently known of practicing the invention and to enable others skilled in the art to utilize the invention as such, or in other embodiments, and with the various modifications required by their particular application or uses of the invention. It is intended that the appended claims be construed to include alternative embodiments to the extent permitted by the prior art.

What is claimed is:

1. An apparatus for carrying loads, comprising:

an intermodal container having a standard predetermined length and a predetermined width for carrying loads, wherein the standard predetermined length of the intermodal container is between about 6 m and 17.22 m (20 to 56 ft), an adapter sled, and a pallet, wherein the adapter sled and the pallet are each dimensioned to fit the predetermined width of the container for carrying the pallet atop the adapter sled with a load on the pallet being supported on the adapter sled over an area of the container corresponding to the adapter sled, and wherein the load on the pallet alternatively can be supported directly on the container apart from the adapter sled, over an area of the container corresponding to the pallet, wherein said pallet has a shorter length than a length of the sled, such that the load on the pallet bears on a larger area of the container when on the sled than when the pallet is supported directly on the container, wherein an integer number of sled lengths is equal to the predetermined length of the container, wherein a larger integer number of pallet lengths is equal to the same said predetermined length of the container, and wherein the pallet is removably affixed onto the sled via an attachment device for respectively attaching the pallet to the sled and detaching the pallet from the sled.

2. The apparatus of claim 1 wherein said attachment device affixes the adapter sled to said pallet such that said pallet can be raised by tines of a fork lift truck wherein the adapter sled does not come into contact with said tines, but is suspended beneath the pallet by the attachment device.

3. The apparatus of claim 2 wherein said attachment device further comprises a flexible device that engages surfaces of the adapter sled and the pallet.

4. The apparatus of claim 3 wherein said flexible device comprises one of a belt and a cable.

5. The apparatus of claim 1 wherein said sled has rigid members for limiting movement of the pallet in the horizontal plane.

6. The adapter sled and pallet of claim 5 wherein said rigid members for limiting pallet movement form vertically situated limits cooperating with vertical surfaces of the pallet.

7. The adapter sled and pallet of claim 6 wherein said vertically-situated limits are relieved at their upper ends so as to guide the cooperating vertical surfaces of the pallet into the vertically situated limits.

8. An adapter sled and a pallet, adapted to carry loads in a standardized load carrying length, wherein said pallet and sled are each designed to occupy a predetermined width and have different lengths, the sled being longer than the pallet and capable of carrying the pallet, and the pallet being capable of supporting a load when on the sled or when not on the sled, wherein the sled has a length such that an integer number of sled lengths is equal to the standardized load carrying length, wherein the pallet has a length that is shorter than the length of the sled, and wherein a larger integral number of pallet lengths is equal to the same said standardized load carrying length, and wherein the pallet is configured with receptacles to receive tines of a fork lift truck;

further comprising a mechanical latching attachment device that is operable attachably and detachably to affix the pallet rigidly to the adapter sled, such that the pallet is movable using the tines of the fork lift truck for moving the pallet apart from the adapter sled, and the pallet also is movable by said tines of the fork lift truck to move the pallet and adapter sled as a unit with the adapter sled suspended beneath the pallet by the attachment device;

whereby the standardized length can be occupied by abutting one or both of a plurality of the pallets and the adapter sleds.

9. The adapter sled and pallet of claim 8 wherein said standardized load carrying length is a standard intermodal container load length.

10. The adapter sled and pallet of claim 8 wherein said attachment device falls away from a locked position into an unlocked position when released.

11. In combination, a plurality of sleds, a plurality of pallets, and at least one container, wherein the pallets are configured to carry loads and the sleds are configured attachably and detachably to carry the pallets, wherein the pallets and the sleds are of equal width and the sleds are longer than the pallets, such that a load supported on one of the pallets alone occupies a smaller area of the container than the load supported on one of the pallets on one of the sleds;

wherein the container is a standardized shipping container having a standard load carrying length for receiving plural said sleds and pallets, wherein said pallet and sled are each designed to occupy a predetermined width and have different lengths, the sled being of sufficient length that an integer number of sleds occupies a given length, the pallet being of a shorter length than the sled, wherein a larger integral number of pallets can occupy said given length, and wherein the pallet can be removably affixed on the sled, and wherein the pallet is substantially one half the length of the adapter sled.

12. A method for shipping large cylindrically shaped cargo from a first location to a second location and for shipping cylindrically shaped cargo substantially smaller than said large cylindrically shaped cargo from the second location to the first location comprising the steps of:

mounting said large cylindrically shaped cargo on a combined pallet and sled wherein the pallet and sled are substantially the interior width of a shipping container and the pallet is shorter in length than the sled and where an integral number of sleds can substantially occupy the full interior length of the shipping container and an integral number of pallets can substantially occupy the full interior length of the shipping container;

installing a number of said combined pallets and sleds loaded with large cylindrically shaped cargo in a shipping container sufficient to occupy substantially the full interior length of said shipping container;

shipping said shipping container from said first location to said second location;

removing said combined pallets and sleds loaded with large cylindrically shaped cargo from the shipping container;

mounting said substantially smaller cylindrically shaped cargo on said pallet without said sled;

installing a number of said pallets loaded with said substantially smaller cylindrically shaped cargo in a shipping container sufficient to occupy substantially the full interior length of said shipping container;

shipping said shipping container from said second location to said first location.

13. The method of claim 12 wherein at least one empty adapter sled is also installed in the shipping container along with said pallets loaded with said substantially smaller cylindrically shaped cargo.

14. The method of claim 12 wherein empty sleds are shipped from said second location to said first location by a means other than inserting them in shipping containers containing said pallets loaded with said substantially smaller cylindrically shaped cargo.

* * * * *

UNITED STATES PATENT AND TRADEMARK OFFICE

CERTIFICATE OF CORRECTION

PATENT NO. : 7,383,951 B2
APPLICATION NO. : 11/180154
DATED : June 10, 2008
INVENTOR(S) : Smolenski et al.

It is certified that error appears in the above-identified patent and that said Letters Patent is hereby corrected as shown below:

Title Page; item (54);
In the Title, delete "SHED" and replace with --SLED--.

Signed and Sealed this

Twelfth Day of August, 2008

JON W. DUDAS
*Director of the United States Patent and Trademark Office*

UNITED STATES PATENT AND TRADEMARK OFFICE

CERTIFICATE OF CORRECTION

PATENT NO. : 7,383,951 B2
APPLICATION NO. : 11/180154
DATED : June 10, 2008
INVENTOR(S) : Smolenski et al.

It is certified that error appears in the above-identified patent and that said Letters Patent is hereby corrected as shown below:

Title Page; item (54) and Column 1, line 2;
In the Title, delete "SHED" and replace with --SLED--.

This certificate supersedes the Certificate of Correction issued August 12, 2008.

Signed and Sealed this

Sixteenth Day of September, 2008

JON W. DUDAS
*Director of the United States Patent and Trademark Office*